US011905952B2

(12) United States Patent
Busch et al.

(10) Patent No.: US 11,905,952 B2
(45) Date of Patent: Feb. 20, 2024

(54) SCROLL MACHINE WITH PASSAGE IN SPIRAL, METHOD, VEHICLE AIR CONDITIONING SYSTEM, AND VEHICLE

(71) Applicant: OET GMBH, Lustenau (AT)

(72) Inventors: Christian Busch, Feldkirch (AT); Jochen Bont, Feldkirch (AT); Roman Lässer, Wolfurt (AT)

(73) Assignee: OET GmbH, Lustenau (AT)

( * ) Notice: Subject to any disclaimer, the term of this patent is extended or adjusted under 35 U.S.C. 154(b) by 0 days.

(21) Appl. No.: 17/995,462

(22) PCT Filed: Mar. 30, 2021

(86) PCT No.: PCT/EP2021/058247
§ 371 (c)(1),
(2) Date: Oct. 4, 2022

(87) PCT Pub. No.: WO2021/204591
PCT Pub. Date: Oct. 14, 2021

(65) Prior Publication Data

US 2023/0175506 A1 Jun. 8, 2023

(30) Foreign Application Priority Data

Apr. 9, 2020 (DE) ..... 10 2020 110 096.5

(51) Int. Cl.
*F04C 18/02* (2006.01)

(52) U.S. Cl.
CPC ..... *F04C 18/0215* (2013.01); *F04C 18/0253* (2013.01); *F04C 18/0261* (2013.01)

(58) Field of Classification Search
CPC ..... F04C 18/0215; F04C 18/0253; F04C 18/0261
See application file for complete search history.

(56) References Cited

U.S. PATENT DOCUMENTS

2005/0147514 A1 7/2005 Lifson et al.
2013/0078128 A1 3/2013 Akei
(Continued)

FOREIGN PATENT DOCUMENTS

DE 10 2017 105 175 8/2018
DE 10 2017 110 913 8/2018
(Continued)

OTHER PUBLICATIONS

Search Report issued in corresponding German Patent Application No. 10 2020 110 096.5, dated Feb. 16, 2021, 10 pages.
(Continued)

*Primary Examiner* — Mary Davis
(74) *Attorney, Agent, or Firm* — Hamre, Schumann, Mueller & Larson, P.C.

(57) ABSTRACT

The invention relates to a scroll-type positive displacement machine, in particular a scroll compressor, comprising a highpressure chamber (11), a low-pressure chamber (12), an orbiting displacement spiral (13), a counter spiral (14), and a counterpressure chamber (15) which is located between the low-pressure chamber (12) and the displacement spiral (13), the displacement spiral (13) engaging in the counter spiral (14) in such a way that, during operation, at least a first and a second compression chamber (16*a*, 16*b*) for receiving a working medium are temporarily formed, and the displacement spiral (13) having at least one passage opening (17) for fluidic connection to the counter-pressure chamber (15), wherein the passage opening (17) is located in the displacement spiral (13) in such a manner that, during operation, due to the orbiting movement of the displacement spiral (13), at least sections of the passage opening (17) are temporarily arranged in the first compression chamber (16*a*) and subsequently at least sections of the passage opening are temporarily arranged in the second compression chamber (16*b*).

18 Claims, 10 Drawing Sheets

(56) References Cited

U.S. PATENT DOCUMENTS

Figure 1:
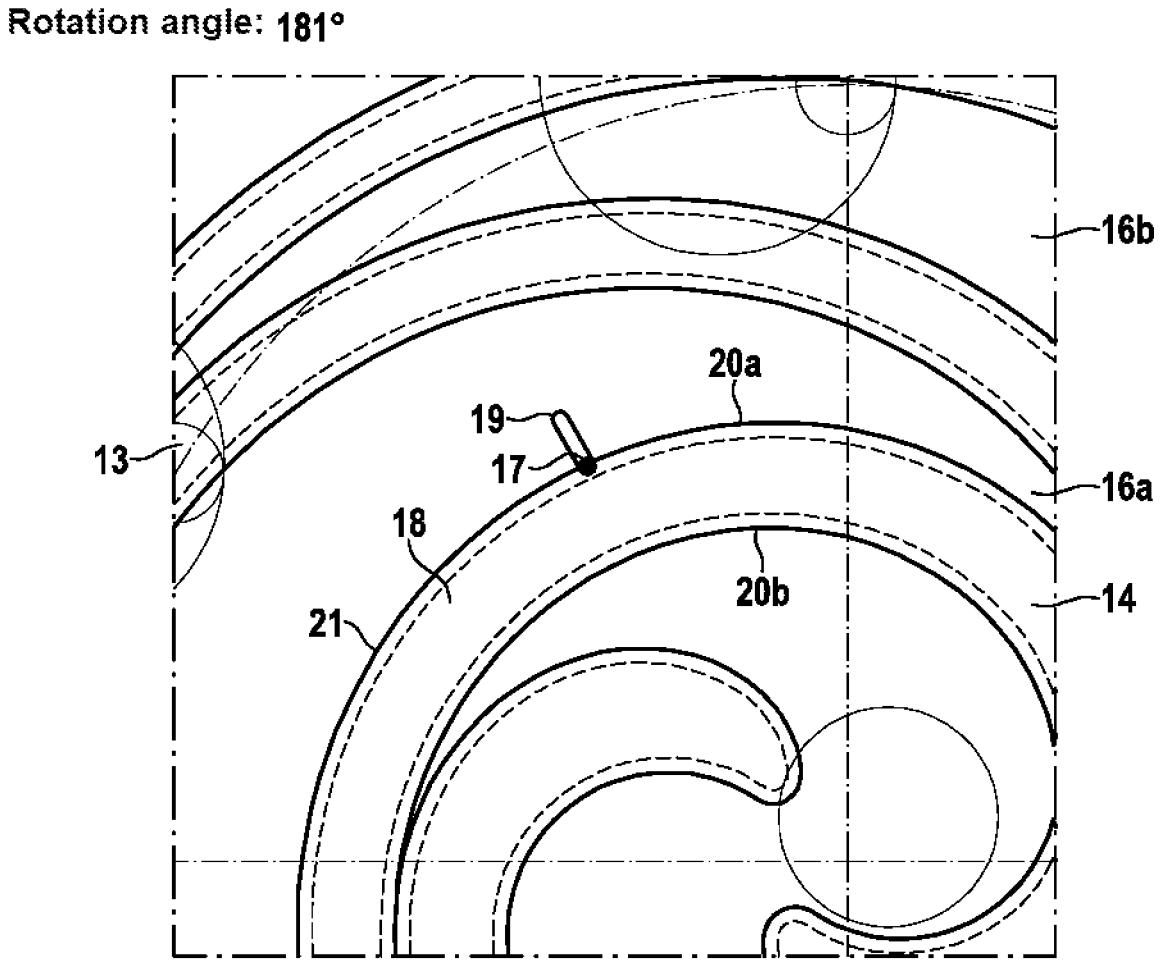

| | | | | |
|---|---|---|---|---|
| 2015/0104342 | A1 | 4/2015 | Yamazaki et al. | |
| 2018/0258933 | A1 | 9/2018 | Obrist et al. | |
| 2018/0335031 | A1 | 11/2018 | Guntermann et al. | |
| 2018/0335032 | A1 | 11/2018 | Obrist et al. | |
| 2023/0167821 | A1* | 6/2023 | Busch | F04C 18/0215 418/55.1 |

FOREIGN PATENT DOCUMENTS

| | | |
|---|---|---|
| DE | 10 2017 110 759 | 11/2018 |
| DE | 10 2019 208 680 | 12/2020 |

OTHER PUBLICATIONS

International Search Report issued in International Application No. PCT/EP/2021/058247, dated Jun. 25, 2021, 14 pages w/translation.

* cited by examiner

SCROLL MACHINE WITH PASSAGE IN SPIRAL, METHOD, VEHICLE AIR CONDITIONING SYSTEM, AND VEHICLE

The invention relates to a scroll-type positive displacement machine. The invention further relates to a method, a vehicle air conditioning system, and a vehicle.

A positive displacement machine of the kind mentioned at the outset is known from DE 10 2017 110 913 B3. DE 10 2017 110 913 B3 describes a scroll compressor, which comprises a displacement spiral and a counter spiral. The displacement spiral engages into the counter spiral. The orbiting displacement spiral forms compression chambers, in which a coolant is compressed. In order to enable a compression of the coolant, the displacement spiral must abut tightly against the counter spiral. Therefore, it is advantageous that the displacement spiral be pressed against the counter spiral. To this end, a counter-pressure chamber is arranged on the side of the displacement spiral facing away from the counter spiral. Such a counter-pressure chamber is also known by the designation back-pressure room. The counter-pressure chamber or back-pressure room functions to build up a pressure. For this purpose, the displacement spiral comprises two openings, which fluidically connect the counter-pressure chamber or back-pressure room with a compression chamber. The pressure in the back-pressure room acts on the displacement spiral with a force that presses the displacement spiral against the counter spiral, so that both spirals are sealed fluid tight relative to each other.

In known scroll compressors of the kind mentioned at the outset, the pressure in the counter-pressure chamber must be just high enough to press the displacement spiral against the counter spiral in such a way that the displacement spiral abuts against the counter spiral in a fluid tight manner. However, the pressure should not be so high that frictional forces arise, which slow down the orbiting motion of the displacement spiral or lead to performance losses.

Providing a high enough pressure for the counter-pressure chamber to press the displacement spiral against the counter spiral while in the process causing the least possible performance losses is associated with a constructive outlay.

Therefore, the object of the present invention is to indicate a positive displacement machine which improves the generation of pressure for pressing the displacement spiral against the counter spiral in such a way as to enable a simple and cost-effective construction for the positive displacement machine. It is further the object of the invention to indicate a method, a vehicle air conditioning system, and a vehicle.

According to the invention, the object is achieved with regard to a positive displacement machine, a method, a vehicle air conditioning system, and a vehicle.

Specifically, the object is achieved by a scroll-type positive displacement machine, in particular a scroll compressor, with a high-pressure chamber, a low-pressure chamber, an orbiting displacement spiral, a counter spiral and a counter-pressure chamber, which is arranged between the low-pressure chamber and the displacement spiral. The displacement spiral engages into the counter spiral in such a way that, during operation, at least a first and a second compression chamber are temporarily formed for receiving a working medium, and wherein the displacement spiral has at least one passage opening for fluid connection with the counter-pressure chamber. The passage opening is arranged in the displacement spiral in such a way that, during operation, the orbiting motion of the displacement spiral causes the passage opening to be temporarily arranged at least in sections in the first compression chamber, and subsequently temporarily arranged at least in sections in the second compression chamber.

The high-pressure chamber is the region in which the compressed working medium flows before it is again fed to a circuit, for example a cooling circuit.

The low-pressure chamber can also be referred to as an intake chamber. The gas flows out of the low-pressure chamber from radially outside between the counter spiral and displacement spiral.

The orbiting motion of the displacement spiral is to be understood as a motion on a circular path.

The working medium preferably involves a cooling fluid, especially preferably a gaseous cooling fluid, for example $CO_2$.

At least a first compression chamber and a second compression chamber are arranged between the counter spiral and the displacement spiral. During operation, a working medium or a fluid is arranged in the compression chambers.

The compression chambers form in the radially outer area. The compression chambers migrate inward in a radial direction. During migration of the compression chambers, the volume of the compression chambers decreases. This increases the pressure in the compression chambers, or compresses the working medium. At the end, the compression chambers combine, and subsequently dissolve each other. This process takes place continuously.

The orbiting motion of the displacement spiral causes the passage opening to move on a circular path. The circular path of the passage opening overlaps with the first compression chamber and the second compression chamber in such a way that the passage opening is temporarily arranged at least in sections in the first, and subsequently in the second compression chamber, and a fluid connection is formed with the counter-pressure chamber.

Expressed differently, the passage opening brushes over the first compression chamber and second compression chamber in such a way that the passage opening is temporarily arranged at least in sections in the first, and subsequently in the second compression chamber, and a fluid connection is formed with the counter-pressure chamber.

The orbiting motion of the displacement spiral causes the passage opening to switch from the first compression chamber to the second compression chamber. As a result, the counter-pressure chamber is alternatingly temporarily fluidically connected with the first compression chamber and with the second compression chamber.

It is possible for more than two compression spaces to be formed between the displacement spiral and counter spiral, and for the passage opening to be temporarily arranged at least in sections in more than two compression chambers.

The invention is advantageous, since temporarily arranging the passage opening sequentially in at least two different compression chambers makes it possible to generate a pressure in the counter-pressure chamber for pressing the displacement spiral against the counter spiral in such a way that the frictional forces that brake or otherwise negatively influence the orbiting motion of the displacement spiral are minimized, while the displacement spiral is simultaneously arranged fluid tightly enough against the counter spiral. The force exerted on the counter spiral by the displacement spiral is produced by the prevailing pressure in the counter-pressure chamber.

This eliminates the need for additional fluid connections that expose the counter-pressure chamber to a pressure and/or influence the pressure in the counter-pressure chamber. Expressed differently, the passage opening in the displacement spiral is sufficient for generating enough pressure in the counter-pressure chamber. This enables a more compact design, since additional fluid connections are not required. In addition, the lower production outlay saves on time and costs.

Preferred embodiments of the invention are indicated in the subclaims.

In an especially preferred embodiment, the counter spiral comprises spiral sections, wherein, while switching from the first compression chamber to the second compression chamber, the passage opening passes at least one spiral section arranged between two compression chambers that border each other in a radial direction.

The spiral sections are to be understood as the sections of the counter spiral or displacement spiral that border the first compression chamber and second compression chamber.

Passing the spiral sections is advantageous, since in this way, the transition between the compression chambers can be defined, and the passage opening can be chronologically arranged in the two compression chambers one after the other.

The term "pass" means to cross a spiral section in a radial direction, or in a direction with a radial directional component. The spiral section can be crossed completely and/or in sections.

In another especially preferred embodiment, the passage opening is arranged in a section of the floor of the displacement spiral.

It is advantageous that the passage opening be arranged in the floor of the displacement spiral, since this makes it easier for the spiral sections to pass through the passage opening. In addition, a straight and shortest possible connection with the counter-pressure chamber can be realized in this way.

The floor is to be understood as the base plate proceeding from which the spiral sections orthogonally extend.

It is advantageous that the passage opening have a circular, elliptical, or ovoid cross section. This enables various advantageous embodiments of the passage opening, which influence the flow characteristics of the working medium. For example, it is possible for the region of the passage opening exposed first during operation while passing a spiral section to have a larger cross section than a region that is still covered by the spiral section. As a result, a good fluid connection is established with the counter-pressure chamber even before the passage opening is completely opened.

In a preferred embodiment, the first compression chamber is fluidically connected with the counter-pressure chamber in an angular range of the rotation angle of the orbiting displacement spiral of 120° to 400°, in particular of 247° to 367°.

In another preferred embodiment, the second compression chamber is fluidically connected with the counter-pressure chamber in an angular range of the rotation angle of the orbiting displacement spiral of 270° to 550°, in particular of 376° to 504°.

The angular ranges of the rotation angle in which the first and second compression chambers are fluidically connected with the counter-pressure chamber are advantageous, since a fluid connection between the compression chambers and counter-pressure chamber is possible over a largest possible region of the rotation angle of the orbiting displacement spiral.

The angular ranges for the first and second compression chambers are selected in such a way that the compression chambers are only fluidically connected with the counter-pressure chamber when the pressure in the first and second compression chambers is high enough to generate enough pressure in the counter-pressure chamber, and press the displacement spiral against the counter spiral in a fluid tight manner and with low performance losses.

It is especially preferred that the first compression chamber be fluidically connected with the counter-pressure chamber at a relative volume of 84% to 40%, in particular of 80% to 46%.

It is further specially preferred that the second compression chamber be fluidically connected with the counter-pressure chamber at a relative volume of 61% to 19%, in particular of 44% to 24%.

The relative volume of the compression chambers must be understood as the variable volume of the compression chambers at a specific point in time during a compression cycle of the positive displacement machine in relation to the initial volume at a rotation angle of 0°. The smaller the relative volume of a compression chamber, the larger the pressure in the respective compression chamber.

The compression cycle must be understood as the periodic process that is characterized by continuously reforming compression chambers.

The relative volume ranges in which the first and second compression chambers are fluidically connected with the counter-pressure chamber are advantageous, since this makes it possible for the compression chambers to each be fluidically connected with the counter-pressure chamber only when the pressure in the respective compression chamber is high enough to enable a fluid tight pressing of the displacement spiral against the counter spiral.

In an embodiment, the passage opening is closed while passing the spiral section while switching from the first to the second compression chamber or vice versa for an angular range of the rotation angle of 5° to 20°.

As a result, the timespan in which the passage opening is closed can be kept as small as possible. More precisely, the timespan in which the passage opening is closed is so small that the impact on the pressure in the counter-pressure chamber is very slight. As a consequence, the timespan in which the passage opening is closed has no effect on the pressure in the counter-pressure chamber or the pressing force on the displacement spiral, and hence no effect on the function of the positive displacement machine either.

In another embodiment, the passage opening has a control geometry that is arranged in the surface of the displacement spiral facing the counter spiral.

For example, a spiral section of the control geometry borders a fluid channel, which fluidically connects the passage opening with a compression chamber before the passage opening is arranged in the compression chamber. The control geometry allows for the passage opening to be fluidically connected with the compression chamber earlier or longer. This makes it possible to reduce the timespan in which the passage opening is closed by the spiral section.

It is advantageous that the control geometry have a depression and/or indentation. As a result, the control geometry can be easily manufactured with known production means and with little effort.

In a preferred embodiment, the spiral sections of the counter spiral have a radially inner spiral wall and a radially outer spiral wall, wherein the control geometry and/or the passage opening is arranged between the spiral walls in the closed state.

The control geometry is advantageously designed in such a way that the first and second passage openings are not fluidically connected with each other at any point in time of the compression cycle. This prevents a pressure drop in the compression chambers.

In an advantageous embodiment, the displacement spiral and/or the counter spiral have a chamfer at least in sections. The chamfer sectionally reduces the width of the spiral section. This reduces the region of the rotation angle traversed by the passage opening so as to pass the spiral section. In this way, the chamfer makes it possible to shorten the timespan in which the passage opening is closed.

Further disclosed and claimed within the framework of the invention is a method for operating a positive displacement machine, in which, during operation, the orbiting motion of the displacement spiral causes the passage opening to be temporarily arranged at least in sections in the first compression chamber, and subsequently temporarily arranged at least in sections in the second compression chamber, and fluidically connect the respective compression chamber with the counter-pressure chamber.

A vehicle air conditioning system with a positive displacement machine is disclosed and claimed within the framework of the invention.

A vehicle with a positive displacement machine according to the invention or a vehicle air conditioning system is disclosed and claimed as another aspect of the invention.

The invention will be explained in more detail below based upon exemplary embodiments with reference to the attached drawings.

Figure 2:
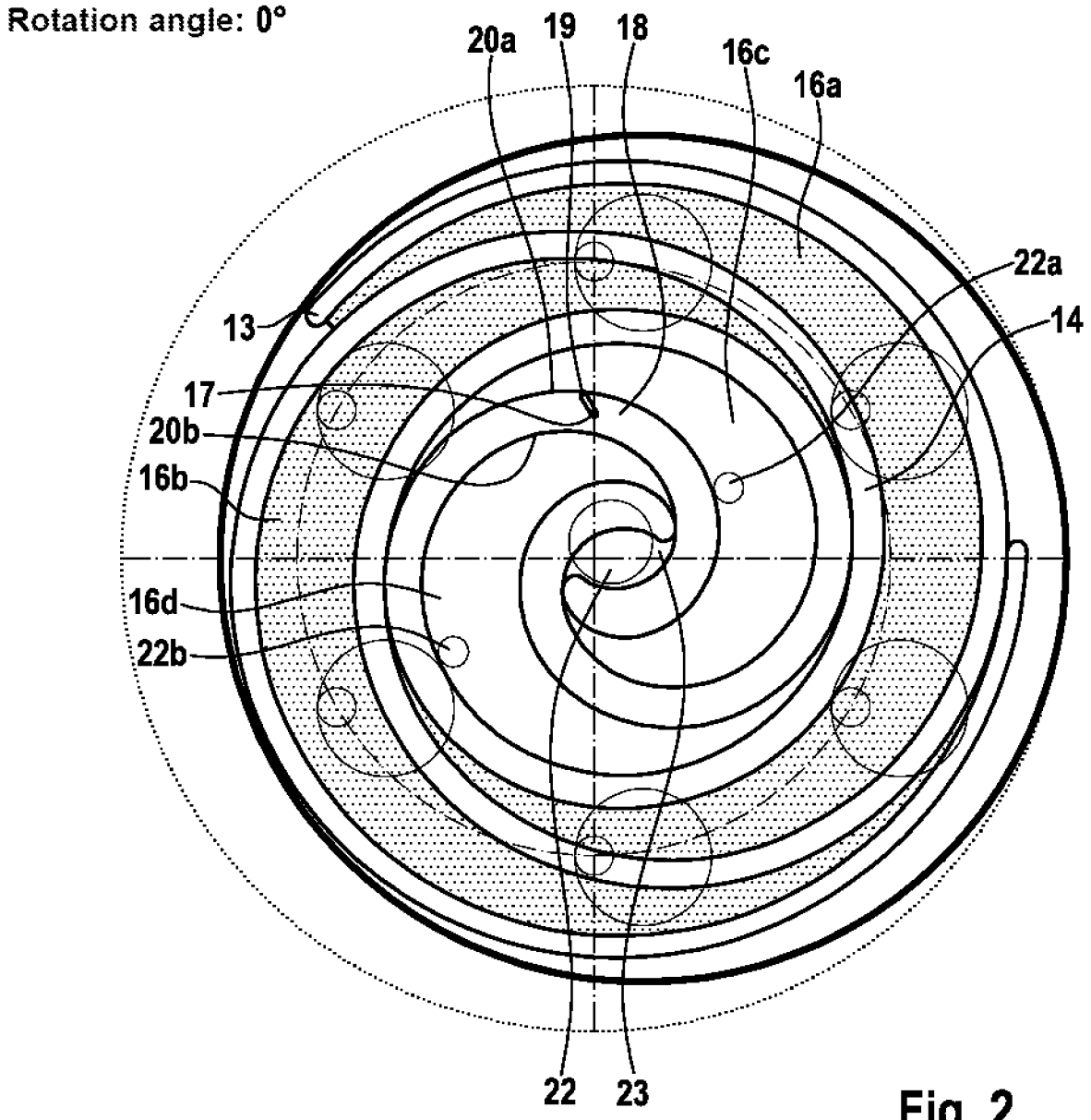
Figure 3:
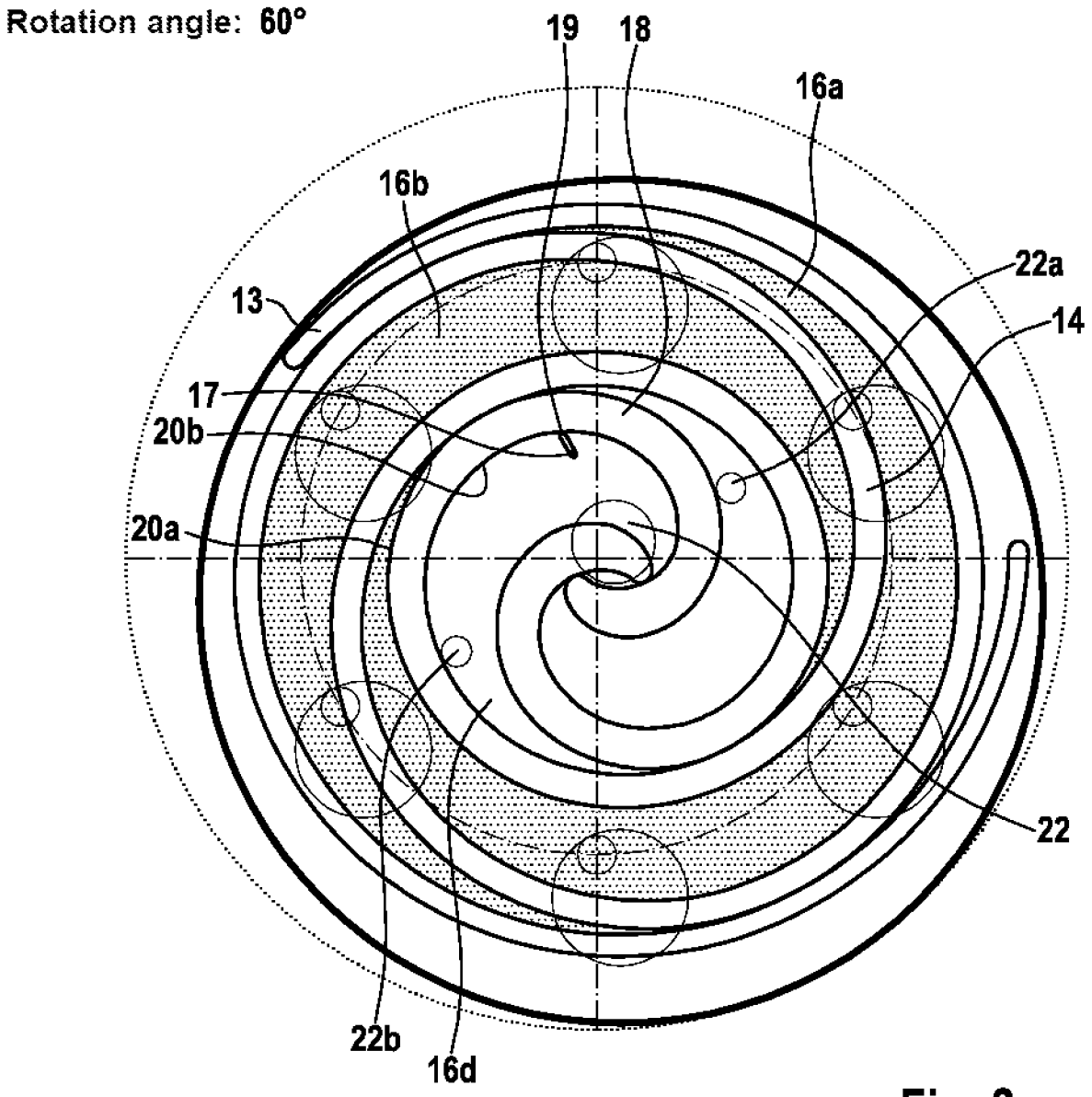
Figure 4:
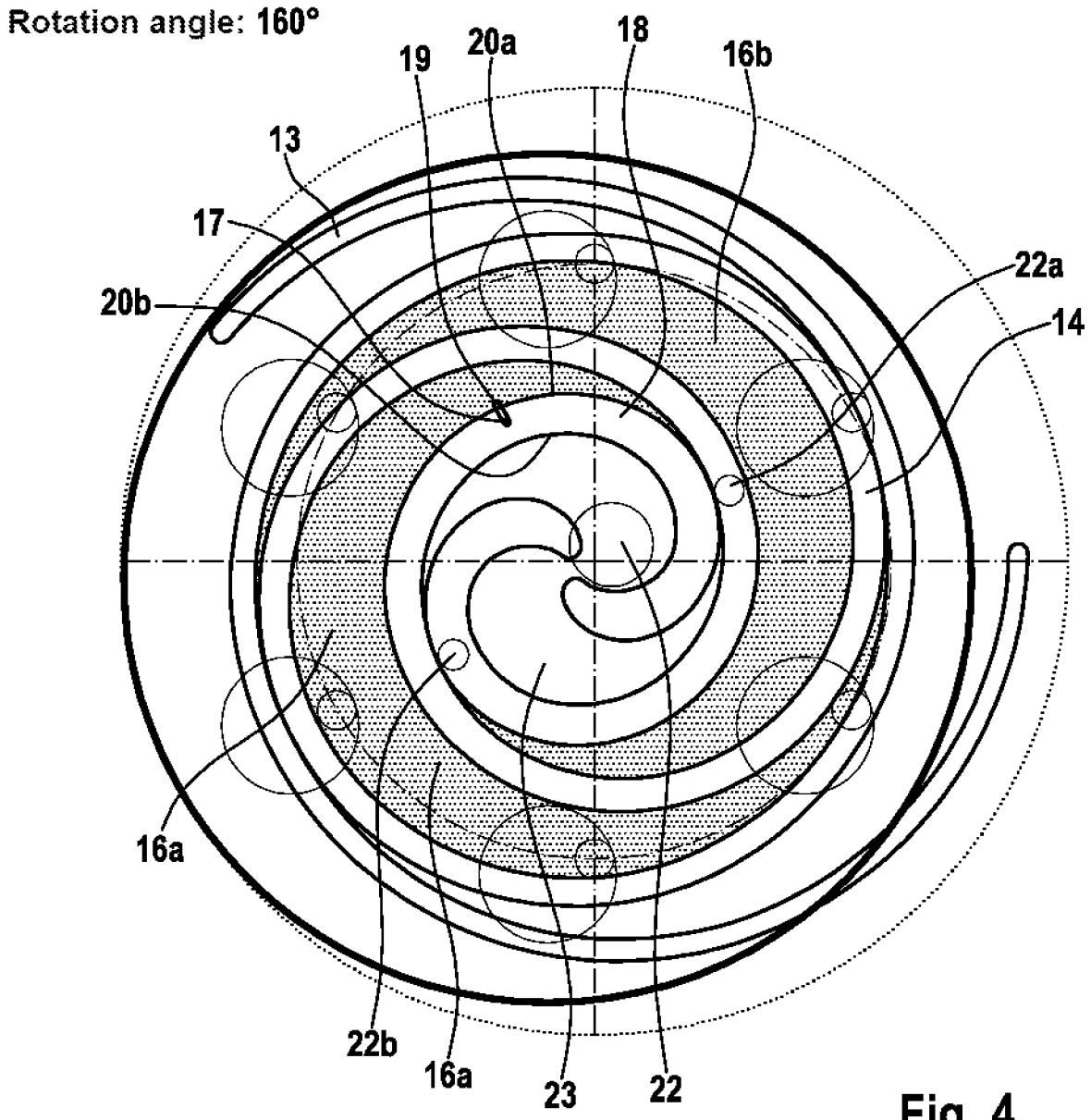
Figure 5:
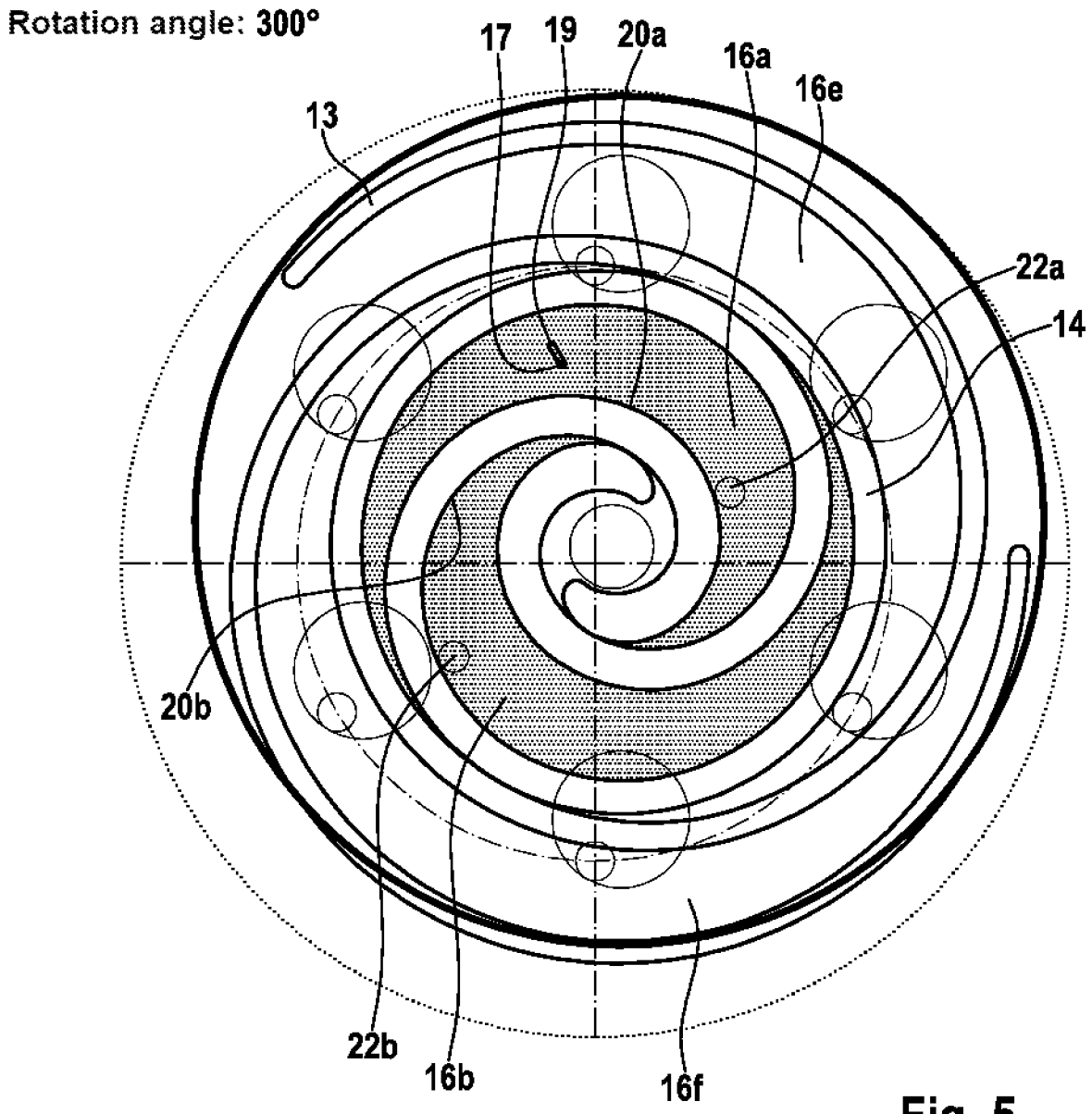
Figure 6:
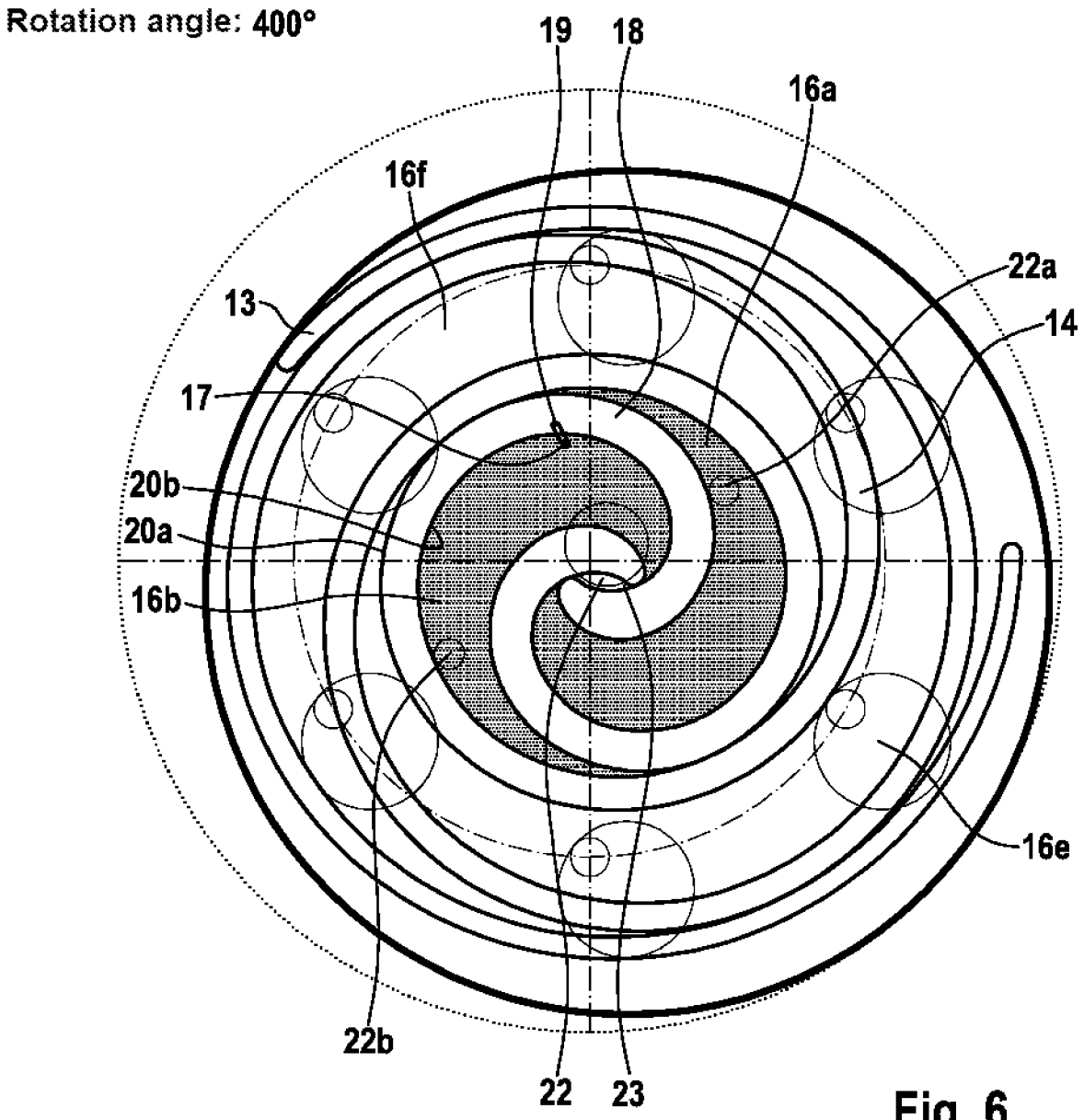
Figure 7:
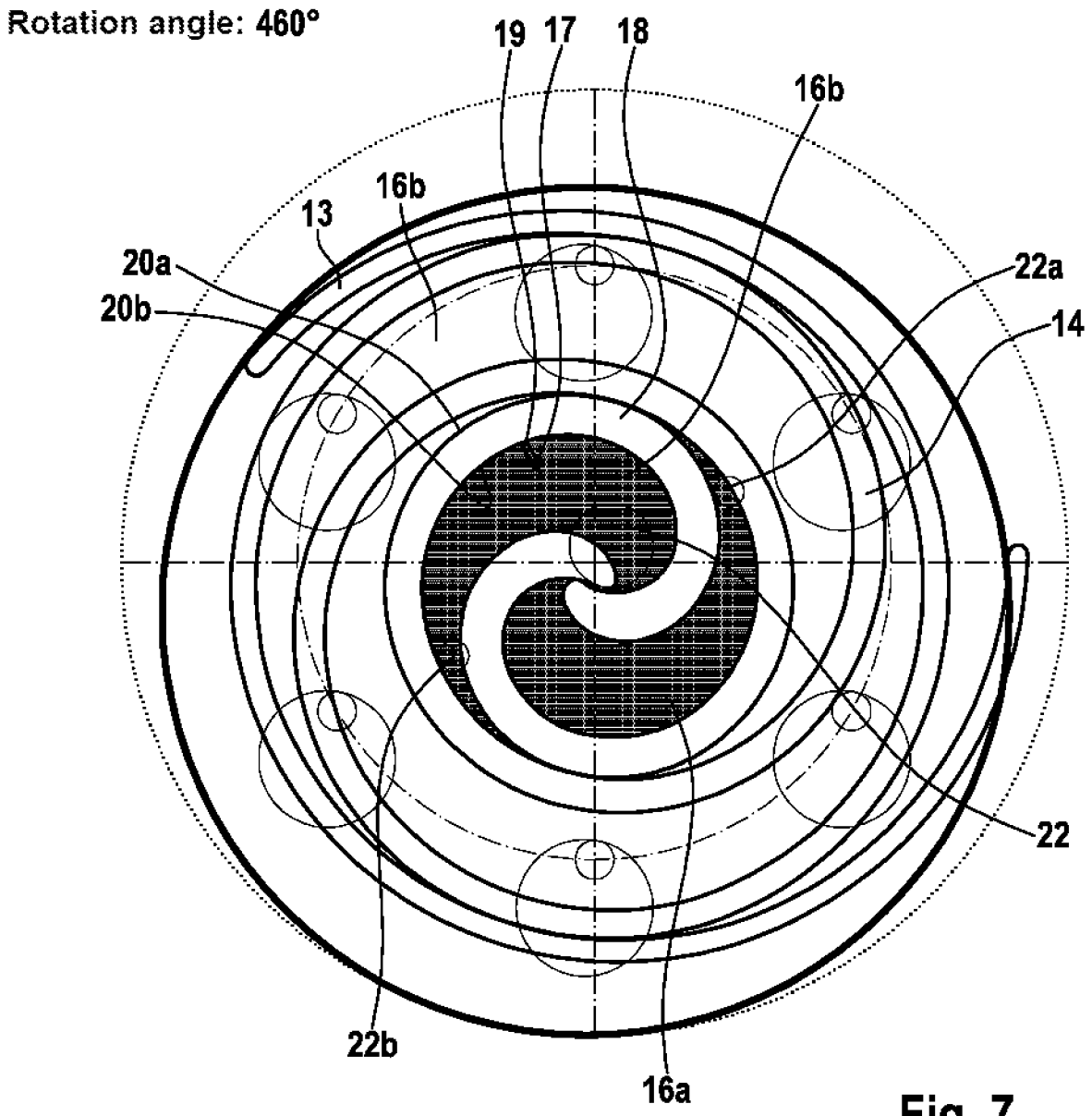
Figure 8:
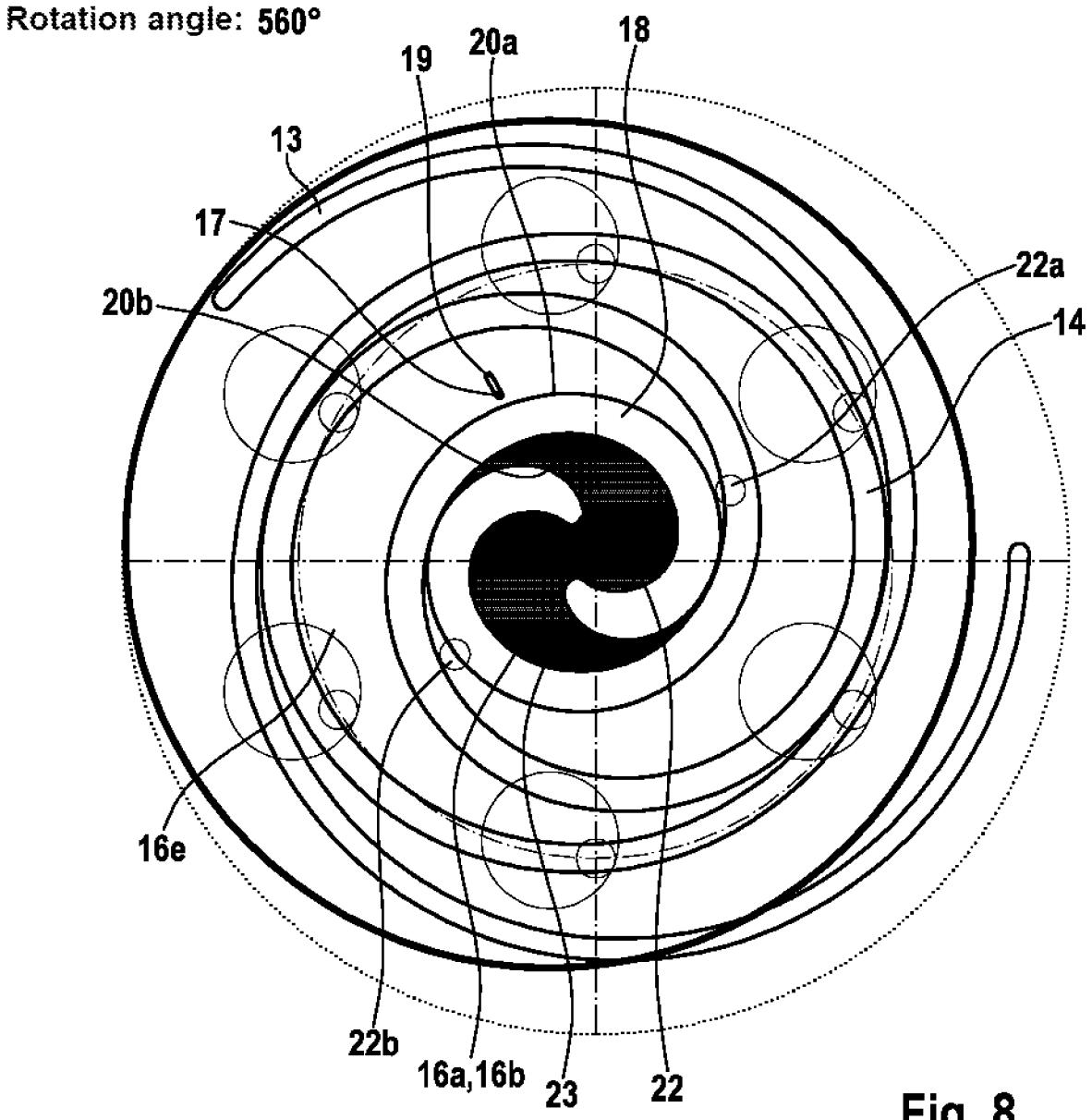
Figure 9:
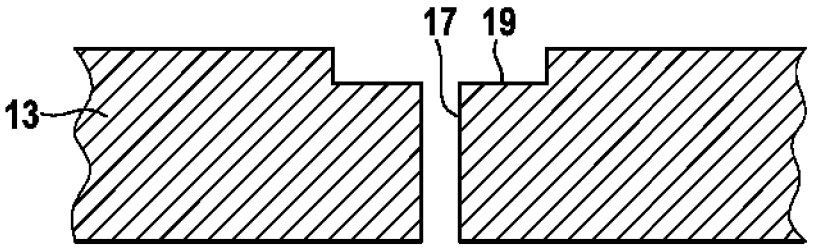
Figure 10:
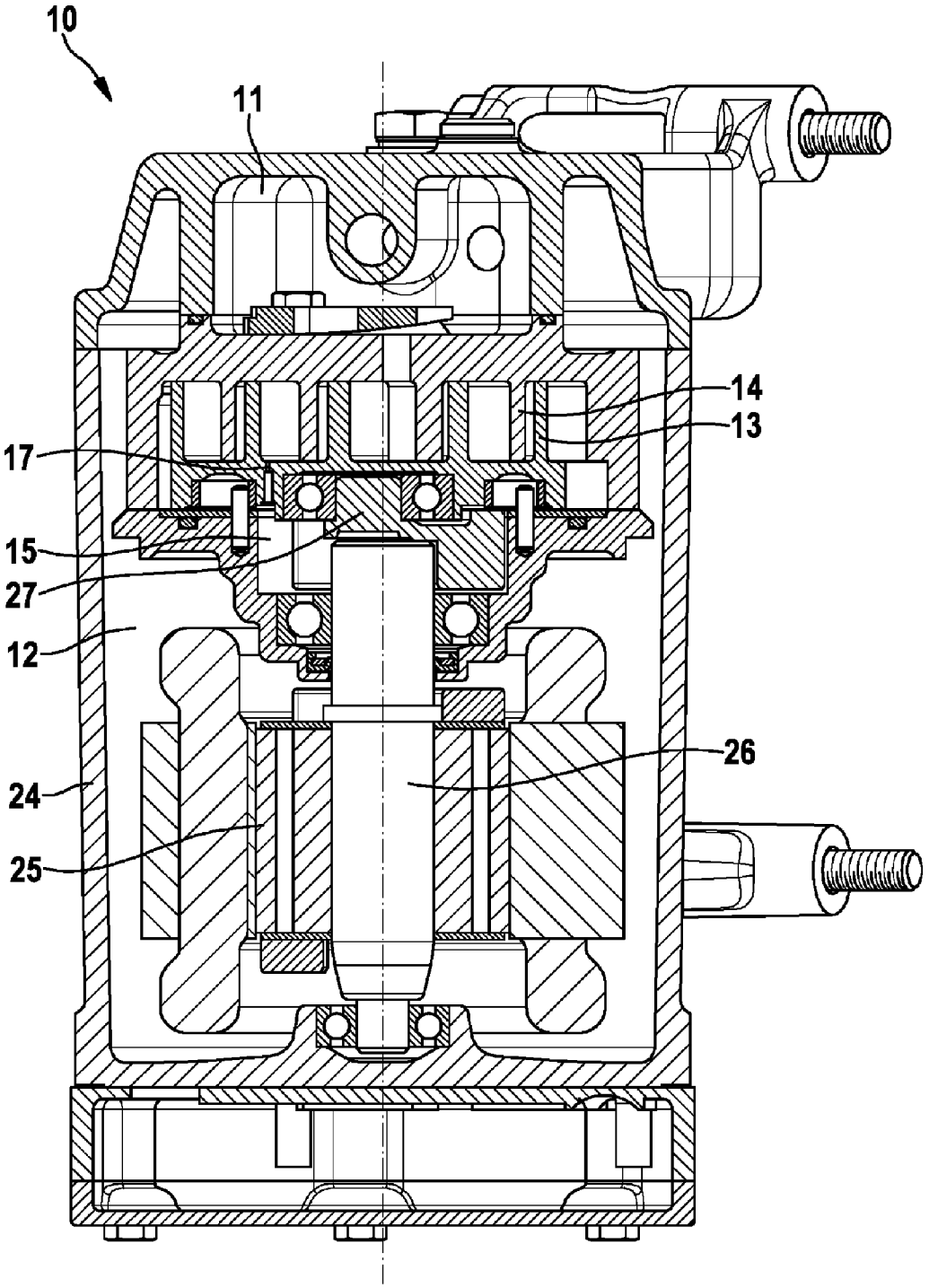
Figure 11:
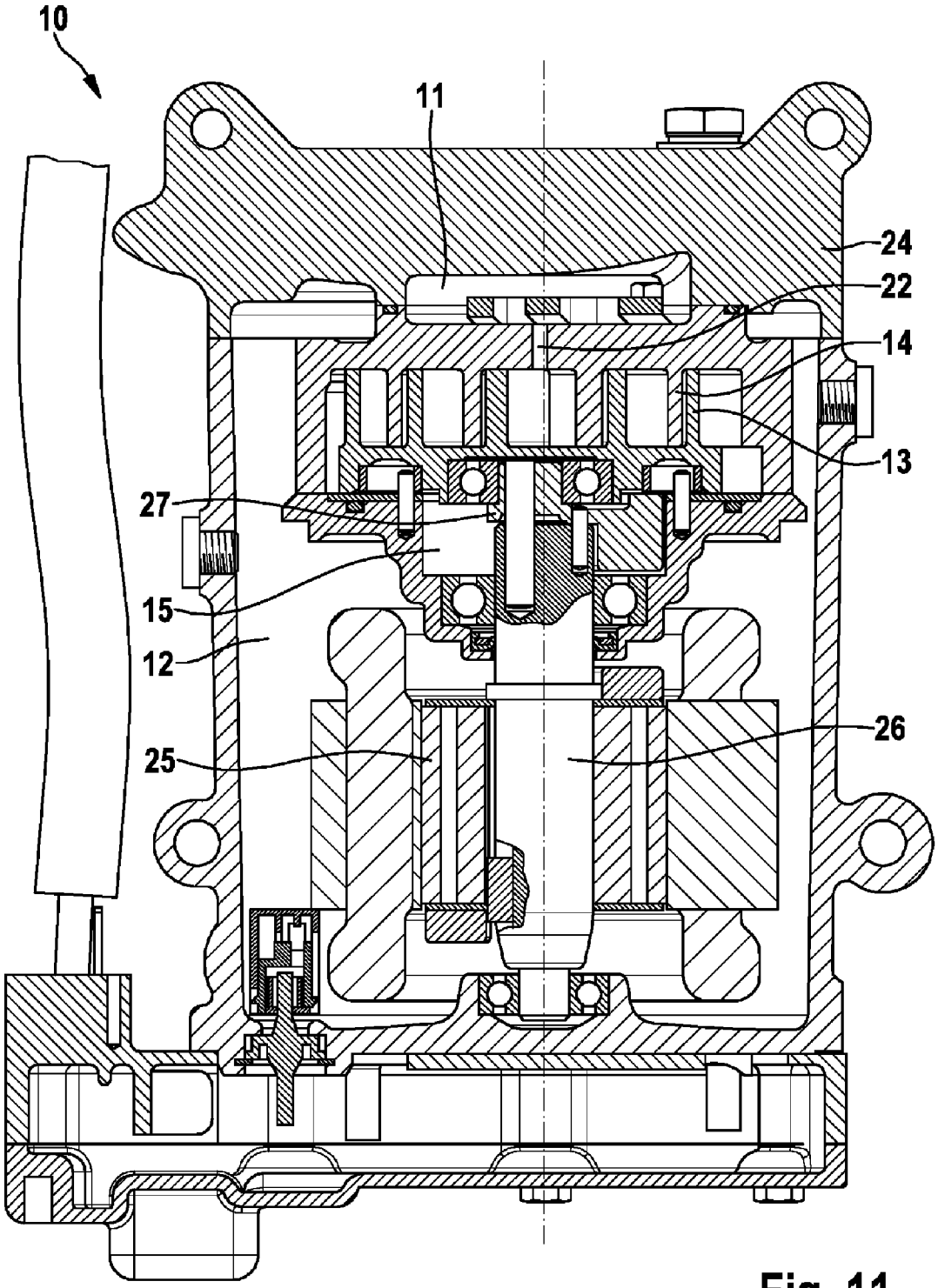

Shown therein are:

FIG. 1 a schematic section of a counter spiral and a displacement spiral of an exemplary embodiment according to the invention of a positive displacement machine;

FIG. 2 a schematic section of a counter spiral and a displacement spiral of an exemplary embodiment according to the invention of a positive displacement machine during a compression cycle at a rotation angle of 0°;

FIG. 3 a schematic section of the positive displacement machine according to FIG. 2 at a rotation angle of 60°;

FIG. 4 a schematic section of the positive displacement machine according to FIG. 2 at a rotation angle of 160°;

FIG. 5 a schematic section of the positive displacement machine according to FIG. 2 at a rotation angle of 300°;

FIG. 6 a schematic section of the positive displacement machine according to FIG. 2 at a rotation angle of 400°;

FIG. 7 a schematic section of the positive displacement machine according to FIG. 2 at a rotation angle of 460°;

FIG. 8 a schematic section of the positive displacement machine according to FIG. 2 at a rotation angle of 560°;

FIG. 9 a section though a displacement spiral of an exemplary embodiment according to the invention of a positive displacement machine;

FIG. 10 a section through an exemplary embodiment according to the invention of a positive displacement machine;

FIG. 11 another section through the positive displacement machine according to FIG. 10.

FIG. 1 shows a schematic view of the arrangement of a displacement spiral 13 and a counter spiral 14 in a positive displacement machine 10.

The displacement spiral 13 and the counter spiral 14 are engaged with each other. The displacement spiral 13 and the counter spiral 14 have spiral sections 18 that are orthogonally arranged on a base plate or a floor. The floor or base plate is circular. The spiral sections 18 extend away from the floor or base plate. In the installed state, the spiral sections of the displacement spiral 13 extend in the direction of the counter spiral 14, and the spiral sections 18 of the counter spiral 14 extend in the direction of the displacement spiral 13.

The counter spiral 14 is fixedly or immovably arranged in the positive displacement machine 10. The displacement spiral 13 is arranged in the positive displacement machine 10 in such a way as to enable an orbiting motion in the counter spiral 14. The structure of the positive displacement machine 10 will be explained in more detail in the description of FIG. 10 and FIG. 11. The orbiting motion must be understood as a movement on a circular path.

An outlet opening 22 is arranged in the region of the center or midpoint of the counter spiral. The outlet opening 22 is arranged eccentrically in the counter spiral 14.

The positions of the displacement spiral 13 during a compression cycle can be represented by the rotation angle of the orbiting motion. The compression cycle must be understood as a passage or period of the continuously recurring compression process. FIG. 1 shows a point in time in a compression cycle of the positive displacement machine 10 at a rotation angle of the displacement spiral 13 of 181°.

A passage opening 17 is arranged in the displacement spiral 13. The passage opening 17 is arranged in the floor or base plate of the displacement spiral 13. The passage opening 17 is arranged in the middle between two spiral sections 18 of the displacement spiral 13. The passage opening 17 runs orthogonally to the surface of the floor. In the installed state, the passage opening 17 runs between a side of the base plate facing the counter spiral 14 and a side of the base plate facing away from the counter spiral 14. The passage opening 17 has a respective opening on both sides of the base plate, which connects the two sides of the floor or base plate with each other. Expressed differently, the passage opening 17 forms a passageway between the two sides of the base plate. The passage opening 17 has a circular cross section. Other shapes are possible. The passage opening 17 preferably has a borehole. The diameter of the passage opening 17 preferably measures between 0.1 mm and 1 mm.

The passage opening 17 has a control geometry 19 for controlling the flow characteristics of the working medium.

The control geometry 19 essentially extends in a radial direction of the displacement spiral 13. In other words, the direction in which the control geometry 19 extends has a radial directional component. Other shapes and directions are alternatively possible for the control geometry 19. The control geometry 19 proceeds from the passage opening 17 and extends radially outside of the displacement spiral 13.

The control geometry 19 is arranged in a surface of the floor or the base plate of the displacement spiral 13. The control geometry 19 does not penetrate through the floor of the displacement spiral 13.

The control geometry 19 has a slit. The slit is straight. The passage opening 17 is arranged at a radially inner end. The radially outer end of the control geometry has a circular section. Other shapes are possible. The control geometry 19 is preferably designed as a groove or notch.

The spiral sections 18 of the counter spiral 14 have a radially inner spiral wall 20*a* and a radially outer spiral wall 20*b*. The dimensions of the control geometry 19 and the passage opening 17 extend between the radially inner spiral wall 20*a* and the radially outer spiral wall 20*b*. The control geometry 19 and the passage opening 17 do not protrude beyond the spiral walls 20*a*, 20*b*. Expressed differently, if the control geometry 19 and a spiral section 18 are superimposed, the control geometry 19 and the passage opening 17 do not protrude beyond the lateral walls 20*a*, 20*b*, but are rather completely covered.

A first compression chamber 16*a* and a second compression chamber 16*b* are formed between the displacement spiral 13 and the counter spiral 14. The compression chambers 16*a*, 16*b* are used to receive and compress a working medium. For example, a gaseous coolant is possible as the working medium. The compression chambers 16*a*, 16*b* will be described in more detail below.

The displacement spiral 13 and the counter spiral 14 each have a chamfer 21 along the spiral walls 20*a*, 20*b*. The chamfer 21 extends along the entire spiral winding. Alternatively, the chamfer 21 is sectionally arranged on the spiral sections 18. This makes it possible for the chamfer 21 to be arranged only in those regions of the spiral sections 18 in which the passage opening 17 passes the spiral sections 18 when switching between the two compression chambers 16*a*, 16*b*.

FIG. 2 to FIG. 8 schematically depict various states of a compression cycle of a positive displacement machine 10. The positions of the displacement spiral 13 and counter spiral 14 relative to each other are described below as snapshots with a focus on the geometry of the respective components.

FIG. 2 shows a schematic view of a compression cycle with a displacement spiral 13 and a counter spiral 14 that intermesh at a rotation angle of 0°.

The compression cycle of the positive displacement machine 10 begins at a rotation angle of 0°. The rotation angle of 0° describes the state in which one of the at least two compression chambers 16*a*, 16*b* is closed. It is possible that both compression chambers be closed at 0°.

A compression chamber is closed when the compression chamber is enveloped fluid tight by the displacement spiral 13 and the counter spiral 14.

The first compression chamber 16*a* is still open. The second compression chamber 16*b* is closed. The compression chambers 16*a*, 16*b* are arranged in the radially outer region of the spirals 13, 14. Two additional first and second compression chambers 16*c*, 16*d* of a preceding compression cycle are formed in the radially inner region of the displacement spiral and counter spiral 14. The relative volume of the compression chambers 16*a*, 16*b* is larger than the relative volume of the compression chambers 16*c*, 16*d*.

An inner compression chamber 23 is arranged in the region of the center of the arrangement of the displacement spiral 13 and counter spiral 14. The inner compression chamber 23 is formed out of two combined compression chambers.

In addition, two secondary outlet openings 22*a*, 22*b* or intake openings are arranged between the outlet opening 22 and the radially outer region of the counter spiral 14. The secondary outlet openings 22*a*, 22*b* each have varying radial distances from the center of the counter spiral 14.

The passage opening 17 with the control geometry 19 is arranged in the displacement spiral 13. The passage opening 17 and the control geometry 19 are covered by a spiral section 18 of the counter spiral 14. For this reason, the passage opening 17 is closed.

FIG. 3 shows a snapshot of the compression cycle at a rotation angle of the displacement spiral 13 of 60°. Both compression chambers 16*a*, 16*b* are closed on FIG. 3. The relative volumes of the compression chambers 16*a*, 16*b* on FIG. 3 are smaller than the relative volumes of the compression chambers 16*a*, 16*b* on FIG. 2.

The passage opening 17 and the control geometry 19 are arranged in the compression chamber 16*d*. Expressed differently, the passage opening 17 is not covered or closed by a spiral section 18.

FIG. 4 shows a view of the compression cycle at a rotation angle of 160°. The relative volumes of the compression chambers 16*a*, 16*b* are less than in the figures described above.

The passage opening 17 is covered by a spiral section 18 of the counter spiral 14. The control geometry 19 protrudes partially into the first compression chamber 16*a*. Therefore, the passage opening 17 is fluidically connected with the first compression chamber 16*a*.

The compression chambers 16*c*, 16*d* have combined to form the inner compression chamber 23.

FIG. 5 shows a view of the compression cycle at a rotation angle of 300°. The relative volumes of the first and second compression chambers 16*a*, 16*b* have diminished further. New compression chambers 16*e*, 16*f* begin to form in the radially outer region of the two spirals.

The passage opening 17 and the control geometry 19 are arranged completely in the first compression chamber 16*a*.

FIG. 6 shows the compression cycle at a rotation angle of 400°. Two new compression chambers 16*e*, 16*f* have formed in the radially outer region of the displacement spirals 13, 14. The relative volumes of the compression chambers 16*a*, 16*b* have diminished further. The passage opening 17 and a section of the control geometry 19 are arranged in the second compression chamber 16*b*. Part of the control geometry 19 is covered by the spiral section 18 of the counter spiral 14. The outlet opening 22 is arranged partially in the inner compression chamber 23 and in the second compression chamber 16*b*.

FIG. 7 shows the compression cycle at a rotation angle of 460°. The relative volumes of the first and second compression chambers 16*a*, 16*b* have diminished further. The passage opening 17 and the control geometry 19 are completely arranged in the second compression chamber 16*b*. The outlet opening 22 is arranged in the second compression chamber 16*b*. The outlet opening 22 is partially covered by the displacement spiral 13.

FIG. 8 shows the compression cycle at a rotation angle of the displacement spiral 13 of 560°. The first and second compression chambers 16*a*, 16*b* have combined to form an inner compression chamber 23. The outlet opening 22 is completely arranged in the inner compression chamber 23. The passage opening 17 and the control geometry 19 are completely arranged in the newly formed first compression chamber 16*e*.

FIG. 9 shows a section through the displacement spiral 13 in the region of the passage opening 17 and the control geometry 19. The passage opening 17 extends along a straight line. The passage opening 17 extends orthogonally to the surface of the displacement spiral 13. The surface must here be understood as the surface that faces the counter spiral 14.

The control geometry 19 is arranged in the surface of the displacement spiral 13. Expressed differently, the control geometry 19 comprises a depression. Possible embodiments for the control geometry 19 include a notch or groove, for example. It is possible that the control geometry 19 comprise a gap, wherein the gap is open in the direction of the counter spiral 14 and closed in the direction of the displacement spiral 13. The control geometry 19 runs along a radial direction of the displacement spiral 13. Other alignments and geometries are conceivable for the control geometry. It is also possible that the control geometry 19 not run straight.

FIG. 10 and FIG. 11 each show sections through an exemplary embodiment according to the invention of a positive displacement machine 10.

The positive displacement machine 10 comprises a housing 24. The housing 24 has a cylindrical shape. A drive 25 is arranged in the housing 24. For example, an electric motor or a mechanical drive 25 is conceivable as the drive 25. The drive 25 is connected with a shaft 26, and drives the shaft 26.

The shaft 26 extends in a longitudinal direction of the housing 24. An eccentric bearing 27 with an eccentric pin is arranged at an axial end of the shaft 26. The eccentric bearing 27 connects the displacement spiral 13 with the shaft 26.

Inside the housing 24, a counter spiral 14 is arranged on the side of the displacement spiral 13 facing away from the eccentric bearing 27. The counter spiral 14 is fixedly and immovably arranged in the housing 24 of the positive displacement machine 10. It is possible for the counter spiral 14 to be designed in once piece with the housing 24.

A low-pressure chamber 12 is arranged on the side of the displacement spiral 13 facing away from the counter spiral 14. A counter-pressure chamber 15 is arranged between the low-pressure chamber 12 and the displacement spiral 13.

The displacement spiral 13 is arranged in the housing 24 so that it can move in a direction parallel to the longitudinal direction of the shaft 26. In other words, the displacement spiral 13 can be shifted in the direction of the counter spiral 14 and away from the counter spiral 14. The passage opening 17 is arranged in the floor of the displacement spiral 13. The passage opening 17 makes it possible to fluidically connect the compression chambers 16 with the counter-pressure chamber 15 during operation.

A high-pressure chamber 11 is arranged on the side of the counter spiral 14 facing away from the displacement spiral 13.

The intermeshing spirals 13, 14 form the compression chambers 16. Expressed differently, the compression chambers 16 are bounded by the spiral sections 18 of the displacement spiral 13 and the counter spiral 14.

The working medium, for example a coolant, is aspirated at the beginning of a compression cycle in a radially outer region of the spirals 13, 14. The working medium is transported in the compression chambers 16*a*, 16*b* between the displacement spiral 13 and counter spiral 14.

During operation, the rotation of the shaft 26 and the eccentric connection between the displacement spiral 13 and the shaft 26 produces the orbital motion of the displacement spiral 13.

The orbiting motion of the displacement spiral 13 reduces the relative volumes of the compression chambers 16. The compression chambers 16 are temporary. The compression chambers 16 continuously reform in the outer radial region of the spiral array, and subsequently migrate into the radial interior of the spiral array and dissolve in the radial interior of the spiral array. The movement path of the compression chambers is spiral. Up to five compression chambers 16, 23 are possible in the exemplary embodiment shown on FIGS. 2 to 8. Involved here are a respective two pairs with first and second compression chambers 16 and an inner compression chamber 23. Configurations that comprise more or fewer compression chambers 16, 23 are further possible.

In an angular range of the rotation angle of between 147° and 367°, the passage opening 17 forms a fluid connection between the first compression chamber 16*a* and the counter-pressure chamber 15. The passage opening 17 forms a fluid connection with the second compression chamber 16*b* and the counter-pressure chamber 15 between the angular range of the rotation angle of between 376° and 504°. In the angular range of the rotation angle of between 367° and 376°, the passage opening 17 is closed by a spiral section 18 of the counter spiral 14.

The passage opening 17 is initially arranged in the first compression chamber 16*a*, and subsequently in the second compression chamber 16*b* of a compression cycle. The passage opening 17 is arranged in one of the compression chambers 16*a*, 16*b* a respective once per compression cycle. After the second compression chamber 16*b*, the passage opening 17 migrates to the first compression chamber 16*c* of the following compression cycle.

A portion of the working medium flows through the passage opening 17 and into the counter-pressure chamber 15. This causes the pressure in the counter-pressure chamber 15 to increase. The pressure exerts a force on the displacement spiral 13 in an axial direction. The force acts in the direction of the counter spiral 14. Since the displacement spiral 13 can move in the axial direction, it is pressed against the counter spiral 14. Pressing the displacement spiral 13 against the counter spiral 14 leads to a compression of the working medium with the lowest possible performance losses.

During operation, the control geometry 19 forms a fluidic channel with a side of the counter spiral 14 facing the displacement spiral. This makes it possible for a fluidic connection to be formed between a compression chamber 16 and the counter-pressure chamber 15 before the passage opening 17 is completely or partially arranged in a compression chamber 16.

The compressed working medium flows through the outlet opening 22 and into the high-pressure chamber 11. Passing through the high-pressure chamber 11, the working medium returns to a working circuit, in particular to a cooling circuit. During operation, the varying distances from the midpoint of the counter spiral 14 cause the secondary outlet openings 22*a*, 22*b* to become arranged in different pressure ranges of the positive displacement machine 10.

A compression cycle will be explained below based on FIG. 2 to FIG. 8. In particular the compression chambers 16*a*, 16*b* will here be examined.

FIG. 2 shows the compression cycle at a rotation angle of 0°. At the rotation angle of 0°, one of the at least two compression chambers 16*a*, 16*b* is closed. No fluid connection is formed between one of the compression chambers 16 and the counter-pressure chamber 15 on FIG. 2, since the passage opening 17 with the control geometry 19 is completely covered by a spiral section 18.

At a rotation angle of 60° (see FIG. 3), the first and second compression chambers 16*a*, 16*b* are closed. The relative volumes of the compression chambers 16*a*, 16*b* diminish as the rotation angle grows. The passage opening 17 and the control geometry 19 move on a circular path.

At a rotation angle of 160° (see FIG. 4), the passage opening 17 has migrated further. The passage opening 17 is covered by the spiral section 18, which separates the first compression chamber 16*a* and the second compression chamber 16*b*. The passage opening 17 is not arranged in the first compression chamber 16*a*.

The control geometry 19 of the passage opening 17 is arranged in sections in the first compression chamber 16*a*. The control geometry 19 and the spiral section 18 border a channel. The channel fluidically connects the counter-pressure chamber 15 with the first compression chamber 16*a*.

In the rotation angle of 300° shown on FIG. 5, the passage opening 17 and the control geometry 19 are completely arranged in the first compression chamber 16*a*. The working medium can flow directly through the passage opening 17 and into the counter-pressure chamber 15.

The pressure in the first compression chamber 16*a* on FIG. 5 is higher than in the first compression chamber 16*a* on FIG. 4. The pressure in the compression chambers 16*a*, 16*b* rises as the relative volume diminishes.

As shown on FIG. 6, the passage opening 17 is arranged in the second compression chamber 16*b* at a rotation angle of 400°. The passage opening 17 and the control geometry 19 have passed the spiral section 18 of the counter spiral 14. While passing the spiral section 18, the passage opening 17 was closed by the spiral section 18.

The timespan in which the counter-pressure chamber 15 is not connected with any compression chamber 16 is insufficient for the pressure in the counter-pressure chamber to drop, so that the displacement spiral 13 is no longer pressed fluid tight against the counter spiral 14.

FIG. 7 shows the state of the compression cycle at a rotation angle of 460°. The passage opening 17 and the control geometry 19 are completely arranged in the second compression chamber 16*b*. The first and second compression chambers 16*a*, 16*b* are on the verge of combining and forming the inner compression chamber 23. As evident from FIG. 7, a new compression cycle begins at the same time as the ongoing compression cycle.

At a rotation angle of 560° (see FIG. 8), the first and second compression chambers 16*a*, 16*b* have combined to form the inner compression chamber 23. The passage opening 17 and the control geometry 19 are arranged in a following first compression chamber 16*e* of the new compression cycle.

It is possible for several compression cycles to take place in parallel. The first and second compression chambers 16*a*, 16*b* and the first and second compression chambers 16*c*, 16*d* are allocated to different compression cycles. In other words, each compression cycle comprises a pair of a first and second compression chambers 16*a*, 16*b*.

REFERENCE LIST

10 Positive displacement machine
11 High-pressure chamber
12 Low-pressure chamber
13 Displacement spiral
14 Counter spiral
15 Counter-pressure chamber
16*a* First compression chamber
16*b* Second compression chamber
16*c* First compression chamber
16*d* Second compression chamber
16*e* First compression chamber
16*f* Second compression chamber
17 Passage opening
18 Spiral section
19 Control geometry
20*a* Radially inner spiral wall
20*b* Radially outer spiral wall
21 Chamfer
22 Outlet opening
22*a* Secondary outlet opening
22*b* Secondary outlet opening
23 Inner compression chamber
24 Housing
25 Drive
26 Shaft
27 Eccentric bearing

The invention claimed is:

1. A scroll positive displacement machine with a high-pressure chamber, a low-pressure chamber, an orbiting displacement spiral, a counter spiral and a counter-pressure chamber, which is arranged between the low-pressure chamber and the orbiting displacement spiral, wherein the orbiting displacement spiral engages into the counter spiral in such a way that, during operation, at least a first and a second compression chamber are temporarily formed for receiving a working medium, and wherein the orbiting displacement spiral has at least one passage opening for fluid connection with the counter-pressure chamber, wherein the at least one passage opening is arranged in the orbiting displacement spiral in such a way that, during operation, orbiting motion of the orbiting displacement spiral causes the at least one passage opening to be temporarily arranged at least in sections in the first compression chamber, and subsequently temporarily arranged at least in sections in the second compression chamber;

wherein the first compression chamber is fluidically connected with the counter-pressure chamber in an angular range of the rotation angle of the orbiting displacement spiral of 120° to 400°; and wherein the first compression chamber is fluidically connected with the counter-pressure chamber at a relative volume of 84% to 40%.

2. The scroll positive displacement machine according to claim 1, wherein the counter spiral comprises spiral sections, wherein, while switching from the first compression chamber to the second compression chamber, the at least one passage opening passes at least one spiral section arranged between two compression chambers that border each other in a radial direction.

3. The scroll positive displacement machine according to claim 1, wherein the at least one passage opening is arranged in a section of a floor of the displacement spiral.

4. The scroll positive displacement machine according to claim 1, wherein the at least one passage opening has a circular, elliptical, or ovoid cross section.

5. The scroll positive displacement machine according to claim 1, wherein the angular range comprises 247° to 367°.

6. The scroll positive displacement machine according to claim 1, wherein the second compression chamber is fluidically connected with the counter-pressure chamber in an angular range of the rotation angle of the orbiting displacement spiral of 270° to 550°.

7. The scroll positive displacement machine according to claim 1, wherein the second compression chamber is fluidically connected with the counter-pressure chamber at a relative volume of 61% to 19%.

8. The scroll positive displacement machine according to claim 1, wherein the at least one passage opening is closed while passing a spiral section while switching from the first to the second compression chamber or vice versa for an angular range of the rotation angle of 5° to 20°.

9. The scroll positive displacement machine according to claim 1, wherein the at least one passage opening has a control geometry that is arranged in a surface of the orbiting displacement spiral facing the counter spiral.

10. The scroll positive displacement machine according to claim 9, wherein the control geometry has a depression and/or indentation.

11. The scroll positive displacement machine according to claim 9, wherein the counter spiral has spiral sections, the spiral sections have a radially inner spiral wall and a radially outer spiral wall, wherein the control geometry and/or the at least one passage opening is arranged between the radially inner and the radially outer spiral walls in a closed state.

12. The scroll positive displacement machine according to claim 1, wherein the orbiting displacement spiral and/or the counter spiral have a chamfer at least in sections.

13. A method for operating the scroll positive displacement machine according to claim 1, in which, during operation, the orbiting motion of the orbiting displacement spiral causes the at least one passage opening to be temporarily arranged at least in sections in the first compression chamber, and subsequently temporarily arranged at least in sections in the second compression chamber, and fluidically connect the respective first or second compression chamber with the counter-pressure chamber.

14. A vehicle air conditioning system with the scroll positive displacement machine according to claim 1.

15. A vehicle with the vehicle air conditioning system according to claim 14.

16. A vehicle with the scroll positive displacement machine according to claim 1.

17. A scroll positive displacement machine with a high-pressure chamber, a low-pressure chamber, an orbiting displacement spiral, a counter spiral and a counter-pressure chamber, which is arranged between the low-pressure chamber and the displacement spiral, wherein the orbiting displacement spiral engages into the counter spiral in such a way that, during operation, at least a first and a second compression chamber are temporarily formed for receiving a working medium, and wherein the orbiting displacement spiral has at least one passage opening for fluid connection with the counter-pressure chamber, wherein the at least one passage opening is arranged in the orbiting displacement spiral in such a way that, during operation, orbiting motion of the orbiting displacement spiral causes the at least one passage opening to be temporarily arranged at least in sections in the first compression chamber, and subsequently temporarily arranged at least in sections in the second compression chamber; and wherein the first compression chamber is fluidically connected with the counter-pressure chamber at a relative volume of 84% to 40%.

18. A scroll positive displacement machine with a high-pressure chamber, a low-pressure chamber, an orbiting displacement spiral, a counter spiral and a counter-pressure chamber, which is arranged between the low-pressure chamber and the orbiting displacement spiral, wherein the orbiting displacement spiral engages into the counter spiral in such a way that, during operation, at least a first and a second compression chamber are temporarily formed for receiving a working medium, and wherein the orbiting displacement spiral has at least one passage opening for fluid connection with the counter-pressure chamber, wherein the at least one passage opening is arranged in the orbiting displacement spiral in such a way that, during operation, the orbiting motion of the orbiting displacement spiral causes the at least one passage opening to be temporarily arranged at least in sections in the first compression chamber, and subsequently temporarily arranged at least in sections in the second compression chamber;

wherein the first compression chamber is fluidically connected with the counter-pressure chamber in an angular range of the rotation angle of the orbiting displacement spiral of 120° to 400°; and wherein the first compression chamber is fluidically connected with the counter-pressure chamber at a relative volume of 80% to 46%.

* * * * *